US009653200B2

(12) United States Patent
Ito et al.

(10) Patent No.: US 9,653,200 B2
(45) Date of Patent: May 16, 2017

(54) ELECTROMAGNETIC-VALVE CONTROLLER

(71) Applicant: DENSO CORPORATION, Kariya, Aichi-pref. (JP)

(72) Inventors: Atsushi Ito, Chiryu (JP); Toshio Nishimura, Anjo (JP); Takeshi Akiyoshi, Kariya (JP)

(73) Assignee: DENSO CORPORATION, Kariya (JP)

( * ) Notice: Subject to any disclaimer, the term of this patent is extended or adjusted under 35 U.S.C. 154(b) by 154 days.

(21) Appl. No.: 14/684,481

(22) Filed: Apr. 13, 2015

(65) Prior Publication Data

US 2015/0300522 A1 Oct. 22, 2015

(30) Foreign Application Priority Data

Apr. 18, 2014 (JP) ..... 2014-86104

(51) Int. Cl.

| | |
|---|---|
| ***H01H 9/00*** | (2006.01) |
| ***H01F 7/18*** | (2006.01) |
| ***F01L 9/04*** | (2006.01) |
| *F02D 41/20* | (2006.01) |

(52) U.S. Cl.

CPC ..... *H01F 7/1844* (2013.01); *F01L 9/04* (2013.01); *F02D 41/20* (2013.01); *F02D 2041/2058* (2013.01); *H01F 7/1805* (2013.01); *H01F 2007/1888* (2013.01)

(58) Field of Classification Search

USPC ..... 361/139, 160

See application file for complete search history.

(56) References Cited

U.S. PATENT DOCUMENTS

| | | | | |
|---|---|---|---|---|
| 6,262,874 | B1 * | 7/2001 | Stoll | G05F 1/56 361/154 |
| 6,292,345 | B1 * | 9/2001 | Muller | F02D 41/20 361/160 |
| 6,297,941 | B1 * | 10/2001 | Hoffmann | F01L 9/04 361/160 |
| 6,473,286 | B1 * | 10/2002 | Itabashi | F02D 41/20 123/490 |
| 2011/0295493 | A1 | 12/2011 | Wilms et al. | |
| 2013/0243608 | A1 | 9/2013 | Sakamoto | |

FOREIGN PATENT DOCUMENTS

| | | | |
|---|---|---|---|
| JP | 2000-027693 | A | 1/2000 |
| JP | 2007-139018 | A | 6/2007 |
| JP | 2010-174768 | A | 8/2010 |
| JP | 2012-015146 | A | 1/2012 |

* cited by examiner

*Primary Examiner* — Danny Nguyen

(74) *Attorney, Agent, or Firm* — Posz Law Group, PLC

(57) ABSTRACT

An electromagnetic-valve controller includes a control switch, a control portion regulating a supply current supplied to the electromagnetic valve by controlling a drive of the control switch and controlling to open or close the electromagnetic valve, and a current detection portion detecting the supply current. The control portion controls the drive of the control switch based on a detection result of the current detection portion. The control portion controls the drive of the control switch by using a first pulse signal having a duty ratio that is variable, in a closed period. The control portion controls the drive of the control switch by using a second pulse signal maintaining the supply current to be constant so as to maintain the electromagnetic valve to be in the fully closed state, in a closed-state maintaining period.

7 Claims, 4 Drawing Sheets

ELECTROMAGNETIC-VALVE CONTROLLER

CROSS REFERENCE TO RELATED APPLICATION

This application is based on Japanese Patent Application No. 2014-86104 filed on Apr. 18, 2014, the disclosure of which is incorporated herein by reference.

TECHNICAL FIELD

The present disclosure relates to an electromagnetic-valve controller including a control switch and a control portion regulating a supply current supplied to an electromagnetic valve by controlling a drive of the control switch.

BACKGROUND

JP-2000-27693A discloses an accumulator fuel injection device including an injector injecting and supplying a high-pressure fuel accumulated in an accumulator into an internal combustion engine, and a high-pressure pump pressurizing and feeding the high-pressure fuel of the accumulator. The high-pressure pump includes a regulation valve which regulates a flow rate of a fuel drawn from a fuel tank by using a feed pump, and a rotary pump which pressurizes the fuel supplied from the regulation valve and supplies the fuel to a common rail.

The regulation valve includes a pump linear solenoid, a spring, a cylinder, and a valve body. Since a current is supplied to the pump linear solenoid, a magnetic field is generated. Therefore, the valve body is moved in the cylinder according to the magnetic field.

When the magnetic field is not generated, the regulation valve is in an open state. When the magnetic field is generated, the valve body is moved to cancel a recovery force of the spring, and then the valve body becomes in contact with the cylinder. Therefore, the regulation valve is in a closed state. Then, when the magnetic field disappeared, the valve body is moved by the recovery force of the spring to return to an initial position. Therefore, the regulation valve becomes in the open state. As the above description, the regulation valve is controlled to be in the open state or in the closed state by the magnetic field generated by the current supplied to the pump linear solenoid.

Since the valve body becomes in contact with the cylinder, the regulation valve that is an electromagnetic valve becomes in the closed state. When the valve body becomes in contact with the cylinder, a noise is generated. When a time variation of the current supplied to the pump linear solenoid is increased, an operation speed of the valve body is increased and becomes greater.

SUMMARY

The present disclosure is made in view of the above matters, and it is an object of the present disclosure to provide an electromagnetic-valve controller which reduces a noise generated by an operation of an electromagnetic valve.

According to an aspect of the present disclosure, the electromagnetic-valve controller includes a control switch, a control portion, and a current detection portion. The control switch controls a connection of an electromagnetic valve and a power. The control portion regulates a supply current supplied to the electromagnetic valve by controlling a drive of the control switch, and controls to open or close the electromagnetic valve. The current detection portion detects the supply current. The electromagnetic valve includes a fully open state in a case where the supply current becomes a first predetermined current and a fully closed state in a case where the supply current becomes a second predetermined current that is greater than the first predetermined current. The control portion controls the drive of the control switch based on a detection result of the current detection portion. The control portion controls the drive of the control switch by using a first pulse signal having a duty ratio that is variable, in a closed period that the electromagnetic valve is changed from the fully open state to the fully closed state The control portion controls the drive of the control switch by using a second pulse signal maintaining the supply current to be constant so as to maintain the electromagnetic valve to be in the fully closed state, in a closed-state maintaining period that the electromagnetic valve is maintained to be in the fully closed state.

As the above description, during the closing period where the electromagnetic valve is changed from the fully open state to the fully closed state, the control portion controls the drive of the control switch by using the first pulse signal having the duty ratio that is constant and is less than 100%. Therefore, an operation speed of the valve body of the electromagnetic valve 90 is reduced relative to that of an electromagnetic valve which is changed from the fully open state to the fully closed state by the first pulse signal having the duty ratio equal to 100%. Thus, a noise generated by an operation of the electromagnetic valve is reduced. In this case, the noise is referred to as an operation noise.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
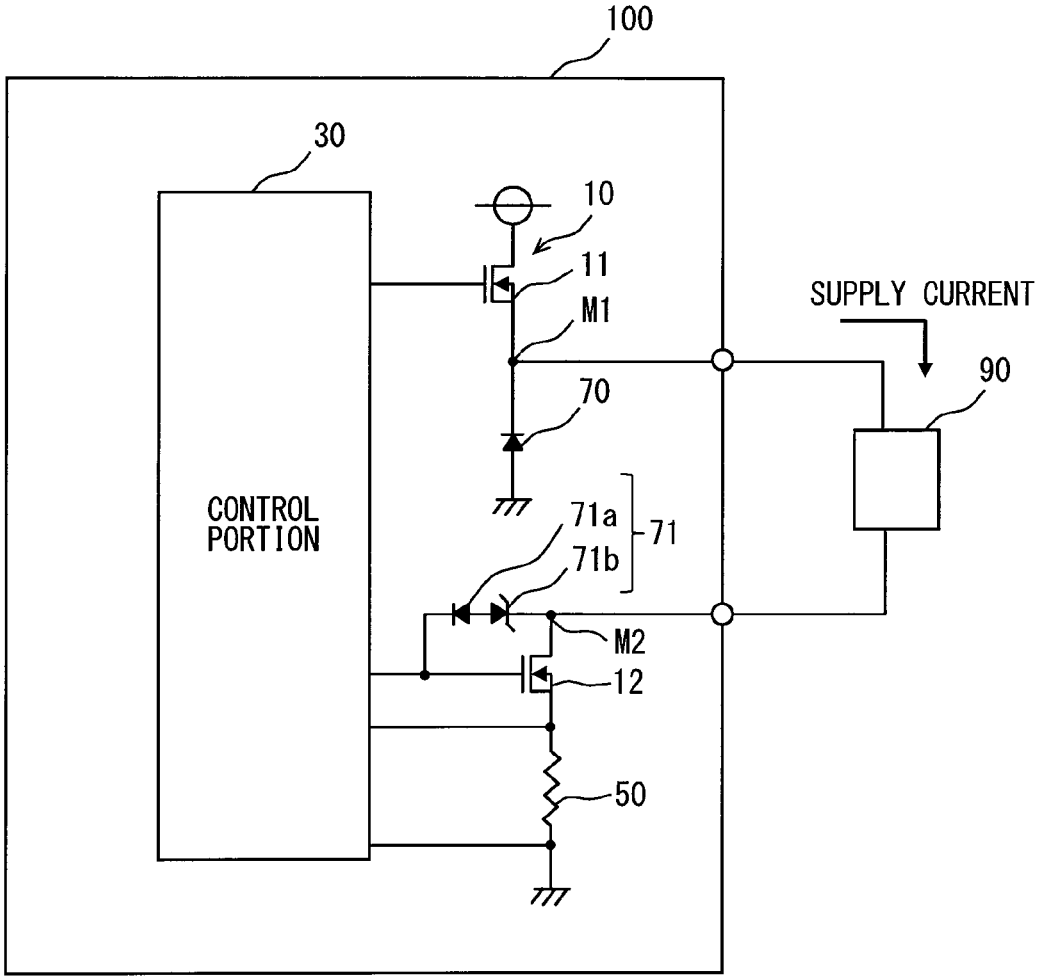
FIG. 1 is a block diagram showing an outline of an electromagnetic-valve controller according to an embodiment of the present disclosure.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

Hereafter, referring to drawings, an embodiment of the present disclosure applied to a high-pressure pump supplying fuel to an engine will be described.

(First Embodiment)

Figure 2:
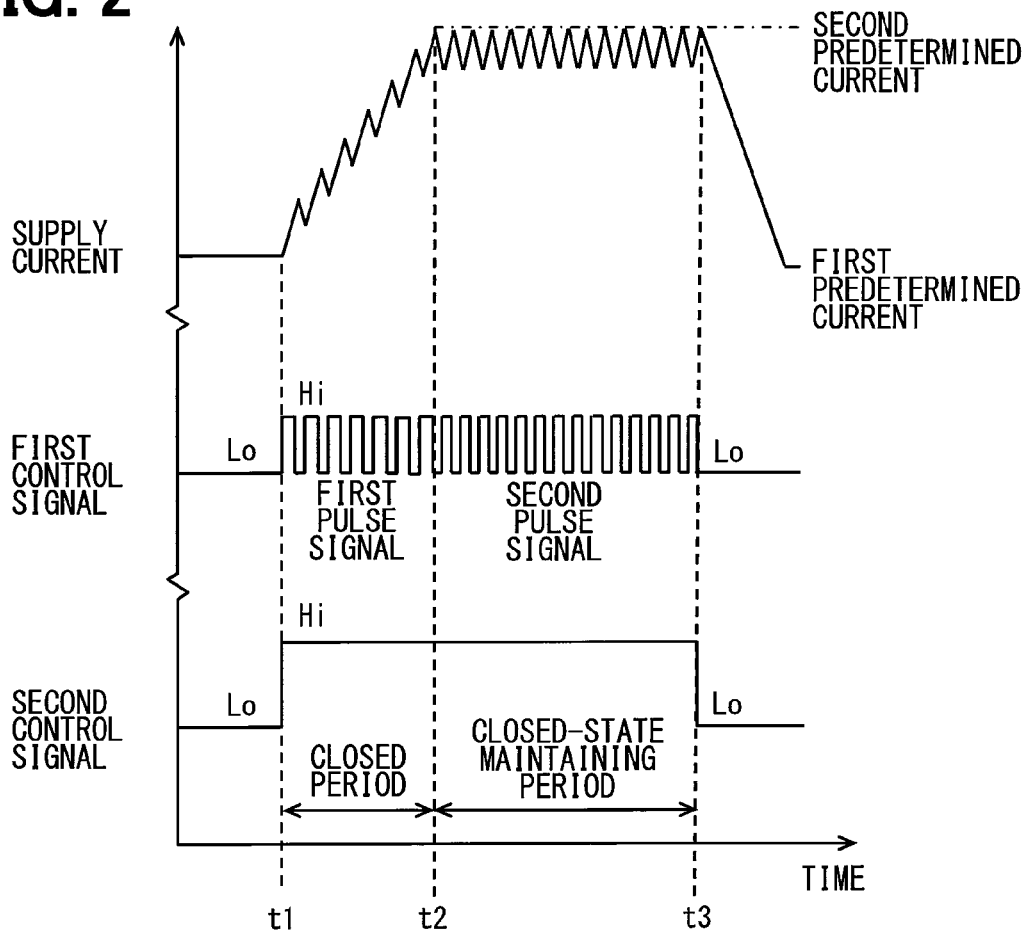
FIG. 2 is a time chart showing an operation of the electromagnetic-valve controller according to the embodiment.
Figure 3:
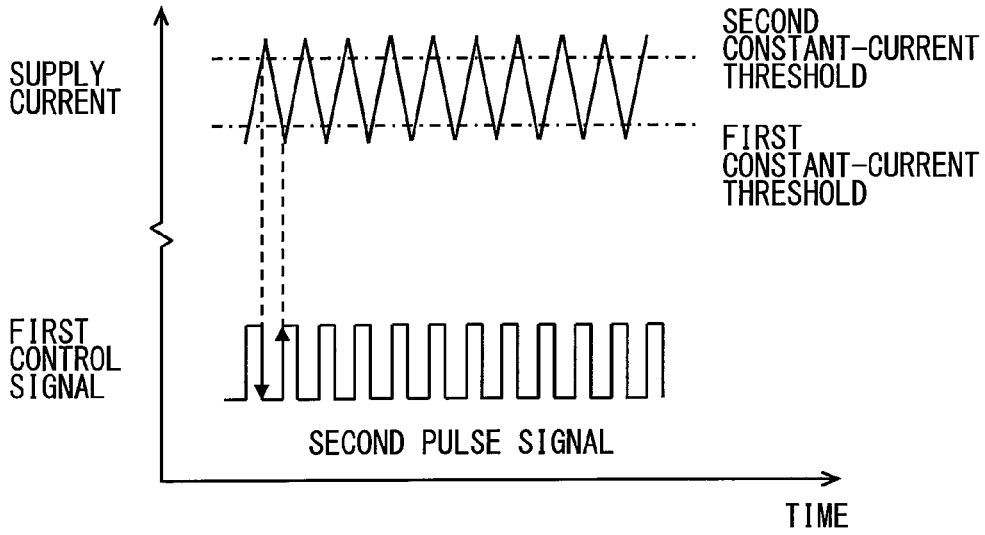
FIG. 3 is a time chart showing a relationship between a supply current and a second pulse signal.

Referring to FIGS. 1 to 3, an electromagnetic-valve controller 100 of the present embodiment will be described. As shown in FIG. 1, the electromagnetic-valve controller 100 includes a control switch 10, a control portion 30, and a resistance 50. The resistance 50 is used for detecting a current. The control switch 10 controls a connection of an electromagnetic valve 90 and a power, and the control portion 30 controls a drive of the control switch 10. The control portion 30 controls the connection of the electromagnetic valve 90 and the power and regulates a current supplied to the electromagnetic valve 90, by controlling the drive of the control switch 10. According to the present embodiment, the current supplied to the electromagnetic valve 90 is referred to as a supply current. When the supply current becomes a first predetermined current, the electromagnetic valve 90 is fully open. In this case, the electromagnetic valve 90 is in a fully open state. When the supply current becomes a second predetermined current that is greater than the first predetermined current, the electromagnetic valve 90 is fully closed. In this case, the electromagnetic valve 90 is in a fully closed state. The control portion 30 detects the supply current based on a current flowing through the resistance 50, and controls the control switch 10 based on the supply current. According to the present disclosure, a part of the control portion 30 and the resistance 50 correspond to a current detection portion.

The electromagnetic-valve controller 100 further includes a recirculation element 70 and an extinguishing element 71. The control switch 10 includes a first switch 11 and a second switch 12. As shown in FIG. 1, the first switch 11 and the recirculation element 70 are connected to each in series in this order from the power to a ground. A first node M1 placed between the first switch 11 and the second switch 12 is connected to a first end of the electromagnetic valve 90. The second switch 12 and the resistance 50 are connected to each other in series in this order from a second end of the electromagnetic valve 90 to the ground. A control electrode of the first switch 11 and a control electrode of the second switch 12 are connected to the control portion 30. The control portion 30 inputs a control signal into the control electrodes to control a drive of the first switch 11 or a drive of the second switch 12. According to the present embodiment, the recirculation element 70 is diode having an anode electrode connected to the ground and a cathode electrode connected to the first node M1. The extinguishing element 71 includes a first diode 71*a* and a second diode 71*b*. The second diode 71*b* is a Schottky diode. An anode electrode of the first diode 71*a* is electrically connected with an anode electrode of the second diode 71*b*. A cathode electrode of the first diode 71*a* is connected to the control electrode of the second switch 12, and a cathode electrode of the second diode 71*b* is connected to a second node M2 placed between the second switch 12 and the second end of the electromagnetic valve 90.

The electromagnetic valve 90 includes an electromagnetic solenoid. The supply current flows through the electromagnetic solenoid that is an induction load. When the control portion 30 controls to drive the first switch 11 and the second switch 12 to be turned on, the supply current flows from the power to the electromagnetic solenoid via the first switch 11 and flows to the ground via the second switch 12 and the resistance 50. In this case, both the first switch 11 and the second switch 12 are in a driving state. An energy that makes the supply current flowing through the electromagnetic solenoid from the first node M1 to the second node M2 is accumulated. Then, when the control portion 30 maintains the second switch 12 to be turned on and controls the first switch 11 to be turned off, even though the supply current is not supplied to the electromagnetic solenoid, a current flows through the electromagnetic solenoid by using the energy. In this case, the first switch 11 is in a non-driving state, and the second switch 12 is in the driving state. Since the control portion 30 controls the first switch 11 to be turned off, the current flows from the recirculation element 70 to the electromagnetic solenoid. As the above description, the recirculation element 70 has a function that make the current generated by the energy accumulated in the electromagnetic flow toward the electromagnetic solenoid in a case where the first switch 11 is turned off.

When the control portion 30 controls both the first switch 11 and the second switch 12 to be turned off after the energy is accumulated in the electromagnetic solenoid, the energy is consumed by the extinguishing element 71 and the second switch 12.

The first switch 11 and the second switch 12 are both metal-oxide-semiconductor field-effect transistors (MOSFETs). The control electrodes are gate electrodes. When the gate electrode of the first switch 11 or the gate electrode of the second switch 12 is inputted by the control signal, the drive of the first switch 11 or the drive of the second switch 12 is controlled. According to the present embodiment, both the first switch 11 and the second switch 12 are n-type MOSFETs. When signals indicating a Lo level of a voltage level is inputted into the gate electrodes, both the first switch 11 and the second switch 12 are turned off. When signals indicating a Hi level of the voltage level is inputted into the gate electrodes, both the first switch 11 and the second switch 12 are turned on. According to the present embodiment, the Lo level is a first level, and the Hi level is a second level. As shown in FIG. 2, the Lo level is less than the Hi level.

The control portion 30 controls to open or close the electromagnetic valve 90 by controlling the control switch 10. The control portion 30 controls the drive of the first switch 11 and the drive of the second switch 12 by using the control signal including the Hi level and the Lo level which are different from each other. When the supply current is not supplied to the electromagnetic valve 90, the electromagnetic valve 90 is in the fully open state. When the supply current is supplied to the electromagnetic valve 90, the electromagnetic valve 90 is changed from the fully open state to the fully closed state. Therefore, when the control portion 30 controls the electromagnetic valve 90 to be in the fully open state, the control portion 30 outputs the control signals indicating the Lo level of the voltage level to both the first switch 11 and the second switch 12. During a closing period that the control portion 30 controls the electromagnetic valve 90 to be changed from the fully open state to the fully closed state or a closing-state maintaining period that the control portion 30 controls the electromagnetic valve 90 to be maintained to the fully closed state, the control portion 30 outputs the control signals indicating the Hi level of the voltage level to the first switch 11 and the second switch 12. Specifically, the control signals include a first control signal and a second control signal. The first control signal having a pulse width that is greater than or equal to 50% and is less than 100% is outputted to the first switch 11, and the second control signal having a pulse width that is equal to 100% is outputted to the second switch 12. Therefore, the electromagnetic valve 90 is changed from the fully open state to the fully closed state and is maintained to be in the fully closed state.

The resistance 50 is connected to the second switch 12 in series between the second end of the electromagnetic valve 90 and the ground. Therefore, when both the first switch 11 and the second switch 12 are turned on, the supply current flows through the resistance 50. As shown in FIG. 1, both ends of the resistance 50 are connected to the control portion 30. The control portion 30 detects a voltage applied to the resistance 50, and detects the supply current flowing through the resistance 50 based on a resistance value of the resistance 50 stored in the control portion 30. Thus, the control portion 30 detects the supply current.

The electromagnetic valve 90 includes an electromagnetic solenoid, a spring, a cylinder, and a valve body, which are not shown. The valve body is provided in the cylinder via the spring, and is moved in the cylinder by a magnetic field generated by the electromagnetic solenoid and a recovery force of the spring. The electromagnetic valve 90 is in the fully open state or in the fully closed state according to a movement of the valve body. When the supply current is equal to the first predetermined current, the electromagnetic valve 90 is in the fully open state. When the supply current is equal to the second predetermined current, the electromagnetic valve 90 is in the fully closed state. According to the present embodiment, the first predetermined current is zero. In this case, the magnetic field is not generated, and the valve body is not moved in the cylinder. When the supply current is increased from the first predetermined current, the valve body is moved by canceling the recovery force of the spring. Then, when the supply current becomes the second predetermined current, the valve body is moved to a position where the electromagnetic valve 90 is in the fully closed state. In this case, when the supply current is decreased, the valve body is moved by the recovery force of the spring, and the electromagnetic valve 90 is opened.

During the closing period and the closing-state maintaining period, since the pulse width of the second control signal outputted to the second switch 12 is equal to 100%, a closed state of the electromagnetic valve 90 is determined according to the pulse width of the first control signal outputted to the first switch 11. The first control signal includes a first pulse signal outputted in the closing period and a second pulse signal outputted in the closing-state maintaining period. The first pulse signal is a pulse signal increasing the supply current to change the electromagnetic valve 90 from the fully open state to the fully closed state, and has a duty ratio that is constant. The second pulse signal is a pulse signal maintaining the supply current to be constant so as to maintain the electromagnetic valve 90 to be in the fully closed state, and has a duty ratio that is inconstant.

As shown in FIG. 2, when the first pulse signal is inputted into the first switch 11 at a time point t1 that is a start of the closing period, the supply current is repeatedly to be increased and decreased so as to be gradually increased to the first predetermined current.

When the supply current is increased to be the second predetermined current at a time point t2, the second pulse signal is inputted into the first switch 11. Then, the supply current is repeatedly to be increased and decreased so as to maintain a time-average value of the supply current to be constant. At a time point t3, the control portion 30 outputs the Lo level of the voltage level to both the first control signal and the second control signal so as to decrease the supply current.

The control portion 30 establishes a first constant-current threshold and a second constant-current threshold which are used for maintaining the electromagnetic valve 90 to be in the fully closed state. The second constant-current threshold is greater than the first constant-current threshold. As shown in FIG. 3, when the supply current becomes less than the first constant-current threshold in the closing-state maintaining period, the control portion 30 outputs the second pulse signal indicating the Hi level of the voltage level. When the supply current becomes greater than the second constant-current threshold in the closing-state maintaining period, the control portion 30 outputs the second pulse signal indicating the Lo level of the voltage level. As the above description, the time-average value of the supply current is constant. Further, the control portion 30 sets at least one of the pulse width of the second pulse signal or a pulse period of the second pulse signal, based on a time change of the supply current. The time change of the supply current is a change of the supply current over time. Furthermore, both the first constant-current threshold and the second constant-current threshold is less than the second predetermined current.

As the above description, during the closing period where the electromagnetic valve 90 is changed from the fully open state to the fully closed state, the control portion 30 controls the drive of the first switch 11 by using the first pulse signal having the duty ratio that is constant and is less than 100%. Therefore, an operation speed of the valve body of the electromagnetic valve 90 is reduced relative to that of an electromagnetic valve which is changed from the fully open state to the fully closed state by the first pulse signal having the duty ratio equal to 100%. Thus, a noise generated by an operation of the electromagnetic valve 90 is reduced. In this case, the noise is referred to as an operation noise.

When the supply current becomes less than the first constant-current threshold in the closed-state maintaining period, the control portion 30 outputs the second pulse signal indicating the Hi level of the voltage level. When the supply current becomes greater than the second constant-current threshold in the closed-state maintaining period, the control portion 30 outputs the second pulse signal indicating the Lo level of the voltage level. Thus, the time-average value of the supply current is constant.

A resistance of the electromagnetic valve 90 differs depending on products. In this case, the resistance is referred to as a load. Even though the supply current that is necessary for maintaining plural electromagnetic valve 90 to be in the fully closed state is constant, a voltage applying time supplying the supply current varies. In this case, the voltage applying time is a connection time between the electromagnetic valve 90 and the power. When the first switch 11 is controlled by a PWM control, the pulse width is necessary to be established according to the load of the electromagnetic valve. In this case, the electromagnetic valve is a control target. According to a configuration that the supply current is controlled to be in a range between the first constant-current threshold and the second constant-current threshold so as to maintain the electromagnetic valve 90 to be in the fully closed state, the supply current maintaining the electromagnetic valve 90 to be in the fully closed state is supplied to the electromagnetic valve 90 without respect to the load of the electromagnetic valve 90. Thus, a general versatility of a control of the electromagnetic valve 90 is improved, and a manufacturing of the control portion 30 is simplified.

Since plural pulse widths are stored and the pulse width is properly selected according to the electromagnetic valve 90, the general versatility can be improved. However, the pulse widths which are stored are limited. It is possible that an improper pulse signal is outputted to the first switch 11, and an extra current may be supplied to the electromagnetic valve 90. Therefore, a current consumed in the electromagnetic valve 90 may be increased. According to the present embodiment, since the supply current is controlled to be in a range between the first constant-current threshold and the second constant-current threshold so as to maintain the electromagnetic valve 90 to be in the fully closed state, it is suppressed that the extra current is supplied to the electromagnetic valve 90 without respect to the load of the electromagnetic valve 90, and it is suppressed that the current consumed in the electromagnetic valve 90 is increased.

The control portion 30 sets at least one of the pulse width of the second pulse signal or the pulse period of the second pulse signal, based on the time change of the supply current. Therefore, comparing with a configuration that both the pulse width of the second pulse signal and the pulse period of the second pulse signal are constant, a variation of the supply current is suppressed in the closed-state maintaining period, and an increasing of the current consumed in the electromagnetic valve 90 is suppressed.

The present disclosure is not limited to the embodiment mentioned above, and can be applied to various embodiments within the spirit and scope of the present disclosure.

According to the present embodiment, the electromagnetic-valve controller 100 is applied to the high-pressure pump supplying the fuel to the engine. However, the electromagnetic-valve controller 100 can be applied to any electromagnetic valve or any valve body that is controlled to be opened or closed by using the supply current.

According to the present embodiment, the control portion 30 functions as the current detection portion. However, the control portion 30 may not function as the current detection portion. In this case, the current detection portion includes the resistance 50 and a detection portion detecting a current flowing through the resistance 50. The current detection portion outputs a detection result of the current to the control portion 30.

According to the present embodiment, the electromagnetic-valve controller 100 includes the recirculation element 70 and the extinguishing element 71. However, the electromagnetic-valve controller 100 may not include the recirculation element 70 and the extinguishing element 71.

According to the present embodiment, the control switch 10 includes the first switch 11 and the second switch 12. However, the control switch 10 may include one of the first switch 11 and the second switch 12. In this case, the first control signal is inputted to the one of the first switch 11 and the second switch 12.

According to the present embodiment, both the first switch 11 and the second switch 12 are n-type MOSFETs. However, the first switch 11 and the second switch 12 may be p-type MOSFETs or insulated gate bipolar transistors (IGBTs).

According to the present embodiment, the pulse width of the first control signal is greater than or equal to 50% and is less than 100%, and the pulse width of the second control signal is equal to 100%. However, a configuration that the pulse width of the second control signal is greater than or equal to 50% and is less than 100% and the pulse width of the first control signal is equal to 100% can be used. In this case, the closed state of the electromagnetic valve 90 is determined according to the pulse width of the second control signal. The second control signal includes the first pulse signal that is outputted in the closed period and the second pulse signal that is outputted in the closed-state maintaining period. Further, a lower limit of the pulse width is 50%. However, a value that is greater than zero can be used as the lower limit. For example, 25% may be set as the lower limit.

According to the present embodiment, the control portion 30 sets at least one of the pulse width of the second pulse signal or the pulse period of the second pulse signal, based on the time change of the supply current. However, at least one of the pulse width of the second pulse signal or the pulse period of the second pulse signal may be constant.

Figure 4:
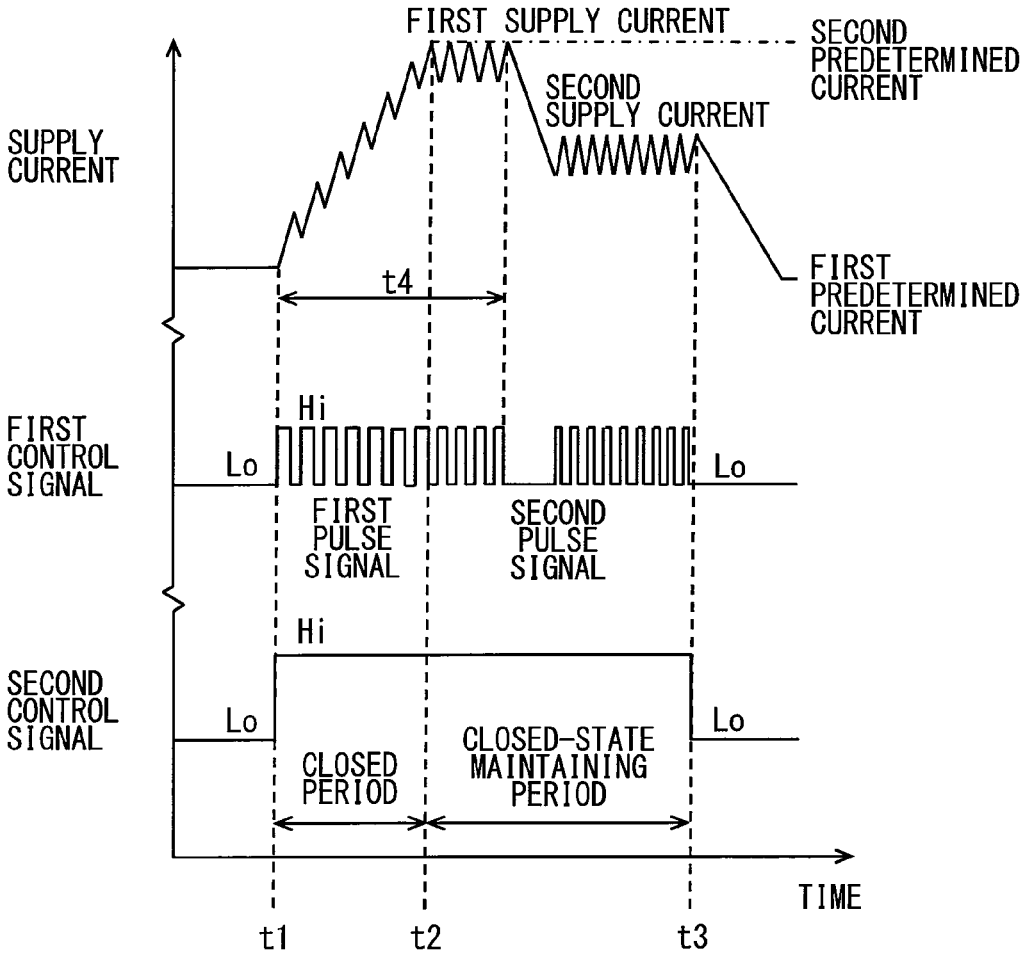
FIG. 4 is a time chart showing a first modification example of the operation of the electromagnetic-valve controller.

According to the present embodiment, the supply current is controlled to be constant in the closed-state maintaining period. However, as shown in FIG. 4, the closed-state maintaining period includes two different periods, and average values of the supply currents in the two different periods are different from each other and are constant. In this case, a first supply current and a second supply current that is less than the first supply current are used as the supply current maintaining the electromagnetic valve 90 to be in the fully closed state. The control portion 30 outputs the second pulse signal corresponding to the first supply current and the second pulse signal corresponding to the second supply current. As shown in FIG. 4, at the time point t2 that is a start of the closed-state maintaining period, the control portion 30 controls the drive of the first switch 11 by using the second pulse signal corresponding to the first supply current. When a first predetermined time period t4 has elapsed since a time point t1, the control portion 30 controls the drive of the control switch 10 by using the second pulse signal corresponding to the second supply current. Comparing with a configuration that the second pulse signal is constant in the closed-state maintaining period, a current consumption of the electromagnetic valve 90 is suppressed in the above configuration. In addition, the second pulse signal corresponding to the second supply current has a time period that the first control signal indicating the Hi level of the voltage level, and the time period is less than that of the second pulse signal corresponding to the first supply current.

According to the present embodiment, the duty ratio of the first pulse signal is constant. However, the duty ratio of the first pulse signal is maintained to be constant and the value of the duty ratio may be variable. Therefore, the operation speed of the electromagnetic valve 90 can be regulated.

Figure 5:
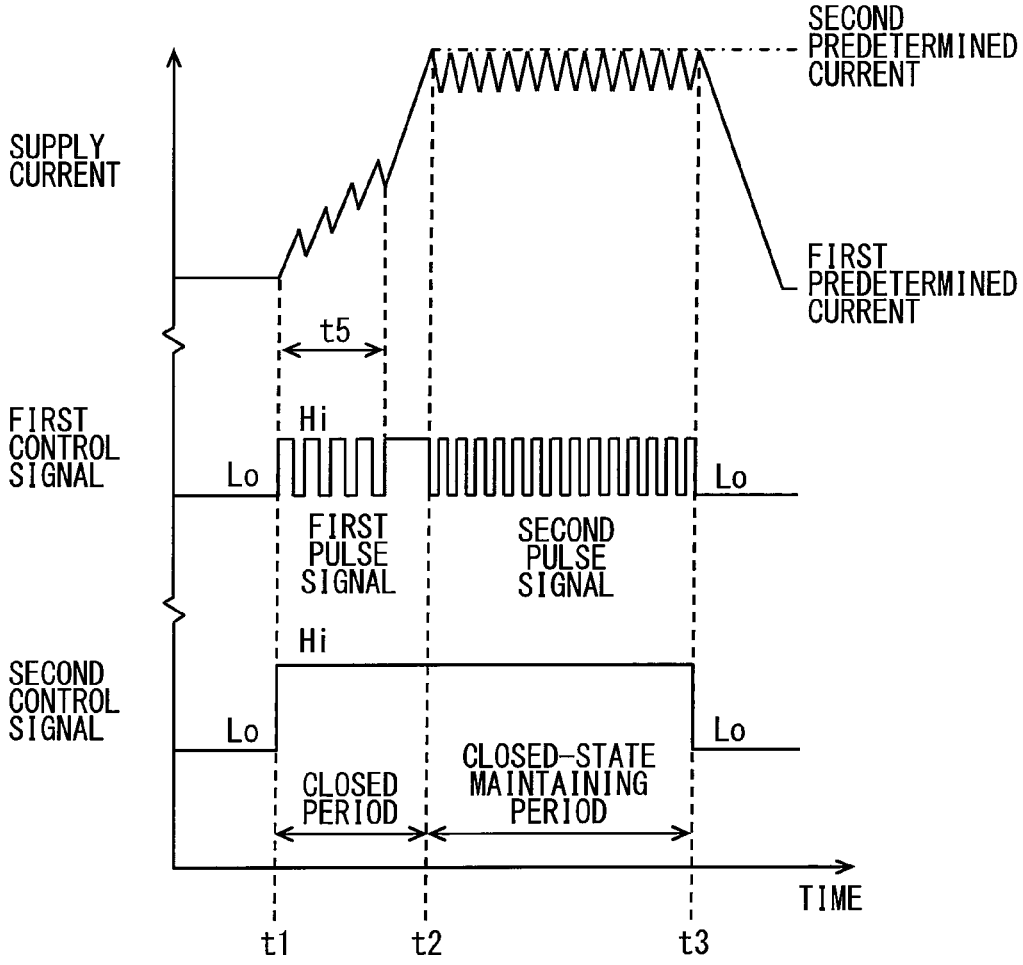
FIG. 5 is a time chart showing a second modification example of the operation of the electromagnetic-valve controller.

According to the present embodiment, the duty ratio of the first pulse signal is constant during an entire period of the closed period. However, as shown in FIG. 5, the control portion may change the duty ratio of the first pulse signal after a second predetermined time period t5 has elapsed since a time point that the first pulse signal is outputted. The second predetermined time period t5 is a period that is necessary for the electromagnetic valve 90 to be changed from the fully open state to the fully closed state. The control portion 30 sets the second predetermined time period t5. The control portion 30 determines whether the supply current reaches the second predetermined current, after the second predetermined time period t5 has elapsed since a time point that the first pulse signal is outputted to the first switch 11. When the control portion 30 determines that the supply current reaches the second predetermined current, the control portion 30 outputs the second pulse signal to the first switch 11. When the control portion 30 determines that the supply current has not reached the second predetermined current, the control portion 30 changes the duty ratio of the first pulse signal so as to increase an amperage of the supply current. As shown in FIG. 5, the control portion 30 changes the duty ratio of the first pulse signal to be equal to 100%.

As the above description, the duty ratio of the first pulse signal may be set to be less than 100% only in a time period of the closed period that the second predetermined time period t5 has elapsed since the time point that the first control signal is outputted to the first switch 11, and the duty ratio of the first pulse signal may be set to be equal to 100% in a time period of the closed period after the second predetermined time period t5 has elapsed since the time point that the first control signal is outputted to the first switch 11. Comparing with a configuration that the duty ratio of the first pulse signal is maintained to be constant in the closed period, the electromagnetic valve 90 can be accurately moved to the fully closed state without shifting from the second predetermined time period t5 in the above configuration.

While the present disclosure has been described with reference to the embodiments thereof, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An electromagnetic-valve controller comprising:

a control switch controlling a connection of an electromagnetic valve and a power;

a control portion regulating a supply current supplied to the electromagnetic valve by controlling a drive of the control switch, the control portion controlling to open or close the electromagnetic valve;

a current detection portion detecting the supply current, wherein the electromagnetic valve includes a fully open state in a case where the supply current becomes a first predetermined current and a fully closed state in a case where the supply current becomes a second predetermined current that is greater than the first predetermined current, and the control portion controls the drive of the control switch based on a detection result of the current detection portion, controls the drive of the control switch by using a first pulse signal having a duty ratio that is variable, in a closed period that the electromagnetic valve is changed from the fully open state to the fully closed state, and controls the drive of the control switch by using a second pulse signal maintaining the supply current to be constant so as to maintain the electromagnetic valve to be in the fully closed state, in a closed-state maintaining period that the electromagnetic valve is maintained to be in the fully closed state, wherein the control portion establishes a second predetermined time period that is necessary for the electromagnetic valve to be changed from the fully open state to the fully closed state, when the control portion determines that the supply current has not reached the second predetermined current after the second predetermined time period has elapsed since a time point that the first pulse signal is outputted to the control switch, the control portion changes the duty ratio of the first pulse signal so as to increase an amperage of the supply current.

2. The electromagnetic-valve controller according to claim 1, wherein when the control portion determines that the supply current has not reached the second predetermined current after the second predetermined time period has elapsed since a time point that the first pulse signal is outputted to the control switch, the control portion changes the duty ratio of the first pulse signal to be equal to 100%.

3. The electromagnetic-valve controller according to claim 1, wherein the control portion establishes a first constant-current threshold and a second constant-current threshold which are used for maintaining the electromagnetic valve to be in the fully closed state, the second constant-current threshold is greater than the first constant-current threshold, the second pulse signal includes a voltage level having a first level and a second level which are different from each other, when the voltage level of the second pulse signal is equal to the first level, the control switch is in a non-driving state, when the voltage level of the second pulse signal is equal to the second level, the control switch is in a driving state, and the control portion controls a time-average value of the supply current to be constant, by (i) outputting the voltage level of the second pulse signal that is equal to the second level when the supply current becomes less than the first constant-current threshold in the closed-state maintaining period, and (ii) outputting the voltage level of the second pulse signal that is equal to the first level when the supply current becomes greater than the second constant-current threshold in the closed-state maintaining period.

4. The electromagnetic-valve controller according to claim 3, wherein the control portion sets at least one of a pulse width of the second pulse signal or a pulse period of the second pulse signal, based on a time change of the supply current.

5. The electromagnetic-valve controller according to claim 4, wherein both the first constant-current threshold and the second constant-current threshold are less than the second predetermined current.

6. The electromagnetic-valve controller according to claim 1, wherein the supply current maintaining the electromagnetic valve to be in the fully closed state includes a first supply current and a second supply current that is less than the first supply current, the control portion outputs the second pulse signal corresponding to the first supply current and the second pulse signal corresponding to the second supply current, the control portion controls the drive of the control switch by using the second pulse signal corresponding to the first supply current, in a start of the closed-state maintaining period, and the control portion controls the drive of the control switch by using the second pulse signal corresponding to the second supply current, after a first predetermined time period has elapsed since the start of the closed-state maintaining period.

7. The electromagnetic-valve controller according to claim 1, wherein the duty ratio of the first pulse signal is greater than or equal to 50%.

* * * * *